US007114723B2

(12) United States Patent
Park

(10) Patent No.: US 7,114,723 B2
(45) Date of Patent: Oct. 3, 2006

(54) OCTATRIX™ —STRATEGY GAME APPARATUS AND METHOD OF PLAY

(76) Inventor: Alexander C. Park, 2905 Gambel La., Plano, TX (US) 75025

( * ) Notice: Subject to any disclaimer, the term of this patent is extended or adjusted under 35 U.S.C. 154(b) by 0 days.

(21) Appl. No.: 10/877,014

(22) Filed: Jun. 26, 2004

(65) Prior Publication Data

US 2005/0285339 A1 Dec. 29, 2005

(51) Int. Cl.
*A63F 3/00* (2006.01)

(52) U.S. Cl. ..... 273/258; 273/241; 273/287

(58) Field of Classification Search ..... 273/241, 273/260, 258, 261; D21/336, 337, 248, 360, D21/3

See application file for complete search history.

(56) References Cited

U.S. PATENT DOCUMENTS

| | | | |
|---|---|---|---|
| 1,877,154 | A | 9/1932 | Weaver |
| 3,684,285 | A | 8/1972 | Kane |
| 3,767,201 | A | 10/1973 | Harper et al. |
| 3,937,471 | A | 2/1976 | Brennan |
| 4,348,027 | A | 9/1982 | Escamilla-Kelly |
| 4,927,157 | A | 5/1990 | Riihiluoma et al. |
| 5,112,056 | A | 5/1992 | Ching |
| 5,277,419 | A | 1/1994 | Craig |
| 5,338,040 | A | 8/1994 | Cutler |
| 5,556,099 | A | 9/1996 | Mardirosian |
| 5,678,819 | A | 10/1997 | Underwood |
| 5,826,880 | A | 10/1998 | Cooper |

*Primary Examiner*—Vishu K. Mendiratta

(57) ABSTRACT

An octahedron-shaped game structure is disclosed for playing a three-dimensional strategy game. A plurality of cubes is introduced to configure the shape of octahedron and two sets of game pieces are provided. The preferred embodiment of the game structure has an arrangement of 11 tiers. The present invention is a game for two players and each player has a king, four rooks, four bishops, four knights, and twelve pawns. Contrasting coloration is used for the game structure and game pieces. It defines two different terrains and two different armies. A method of playing the game is also disclosed, including rules for movement of the game pieces on the game structure. The goal of the present game is to capture the opponent's king, however game can be also ultimately won if a pawn advances all the way to the opponent's pinnacle. The pinnacle is the last surface of each army's terrain.

3 Claims, 10 Drawing Sheets

OCTATRIX™ —STRATEGY GAME APPARATUS AND METHOD OF PLAY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A SEQUENCE LISTING, A TABLE OR A COMPUTER PROGRAM LISTING COMPACT DISC APPENDIX

Not Applicable.

BACKGROUND OF THE INVENTION

The present invention relates to three-dimensional chess-like strategy game, and more particularly to a game apparatus and a method of play.

Chess is a game of strategy. It has been in existence for over thousands of years. The rules of the games have varied with time and region, but a set of standardized rules has evolved for the game of chess, as we know it today. Since the standardization of chess, a significant amount of variation is introduced into the conventional chess game. One such variation of the game is a three-dimensional chess.

Since the first introduction of three-dimensional chess, many modification and changes of the game board have been developed. Different rules and variations of the game pieces have also been proposed. Nevertheless, none of the prior art games has achieved widespread acceptance, or caught up to the popularity of standard two-dimensional chess. Part of the reason for this is that all of the prior art games have had one or more drawbacks that detract from the original reason for adding a third dimension to make the game more fun and exciting.

Three-dimensional chess and other board games have been developed in the prior art wherein boards are vertically aligned one above the other with the game pieces are moved in straight lines on a board as well as between boards. The prior art three-dimensional chess games have been unsuccessful because conventional thinking has led to the forms of three-dimensional chess disclosed in the foregoing patents being played much like two-dimensional chess.

U.S. Pat. No. 1,877,154 issued to Weaver on Sep. 13, 1932 discloses having a game board comprised of two vertically spaced-apart layer members. U.S. Pat. No. 3,684,285 issued to Kane on Aug. 15, 1972 discloses having a game board comprised of four vertically spaced-apart layer members. U.S. Pat. No. 3,767,201 issued to Harper et al. on Oct. 23, 1973 discloses a multi-level game board structure for three-dimensional chess and check games. U.S. Pat. No. 3,937,471 issued to Brennan on Feb. 10, 1976 discloses using two 8 times 8 game boards stacked one over the other, as well as additional chess pieces. U.S. Pat. No. 4,348,027 issued to Escamilla-Kelly on Sep. 7, 1982 discloses Multi-level game board apparatus. U.S. Pat. No. 4,927,157 issued to Riihiluoma et al. on May 22, 1990 discloses a chess-like board game apparatus and method of playing the game.

U.S. Pat. No. 5,112,056 issued to Ching on May 12, 1992 discloses Method of playing a three dimensional pyramidal-chess game. U.S. Pat. No. 5,277,419 issued to Craig on Jan. 11, 1994 discloses a three-layer three-dimensional game board system. U.S. Pat. No. 5,338,040 issued to Cutler on Aug. 16, 1994 discloses a three-dimensional chess game which is played on a four by four by four cubic chessboard. U.S. Pat. No. 5,556,099 issued to Mardirosian on Sep. 17, 1996 discloses a three-dimensional chess game having multiple tiers with role-static pieces and role-altering pieces. U.S. Pat. No. 5,678,819 issued to Underwood on Oct. 21, 1997 discloses a three-dimensional strategy game having three tier game boards with a grid pattern. U.S. Pat. No. 5,826,880 issued to Cooper on Oct. 27, 1998 discloses a multi-level chess game with additional chess pieces.

The problem of the prior art three-dimensional chess games is that they attempt to extend two-dimensional game piece movement into three dimensions where the actual three-dimensional game structure does not exist. Many of the prior art three-dimensional chess games did not successfully extend the chess game into three dimensions. They are still very much like planar games with separated multiple levels that pieces can move between the tiers.

Even though the prior art's innovations may be suitable for the specific individual purposes to which they address, they would not be comparable for the purposes of the present invention as heretofore described.

BRIEF SUMMARY OF THE INVENTION

An octahedron-shaped game structure is introduced to overcome the problems of the prior arts. In the prior arts, game pieces move in straight lines on two-dimensional chessboard. In order to play the three-dimensional strategy game, the game surfaces must have equal extensity in all three dimensions so that game pieces can have the same degree of movement in three-dimensional direction. A plurality of cubes is introduced to configure the shape of octahedron. By these cubic surfaces, the game pieces can move in the vertical surfaces the same way that they can in the horizontal surfaces. These aspects are what makes the game fully three-dimensional, rather than just a planar game on multiple levels.

The primary objective of the present invention is to provide the game apparatus comprising a three-dimensional game structure and game pieces can be played in three-dimensional manner. Another objective of the present invention is to provide such a strategy game which may be mastered quickly and easily by one who knows the basic rules of conventional chess.

Before explaining preferred embodiment of the invention in detail, it is to be understood that the invention is not limited in its application to the details of construction and to the arrangements of the components set forth in the following description or illustrated in the drawings.

BRIEF DESCRIPTION OF THE SEVERAL VIEWS OF THE DRAWING

The present invention will be more fully understood by studying the following description taken in connection with the accompanying drawings, wherein.

LIST OF REFERENCE NUMERALS UTILIZED IN DRAWINGS

40*a*—Red Pawn 40*b*—Blue Pawn
42*a*—Red Knight 42*b*—Blue Knight
44*a*—Red Bishop 44*b*—Blue Bishop
46*a*—Red Rook 46*b*—Blue Rook
48*a*—Red King 48*b*—Blue King
50—Game structure (Electronic simulation version)
52*a*—Red Terrain 60—Cross-dimensional movement
52*b*—Blue Terrain 62—Adjacent surface
54*a*—No Red Knight zone 64—Occupied surface
54*b*—No Blue Knight zone 66—Blocked surface
56*a*—Red Pinnacle
56*b*—Blue Pinnacle
70—Game structure (Physical configuration version)
71*a*—Red Terrain First Tier 71*b*—Blue Terrain First Tier
72*a*—Red Terrain Second Tier 72*b*—Blue Terrain Second Tier
73*a*—Red Terrain Third Tier 73*b*—Blue Terrain Third Tier
74*a*—Red Terrain Fourth Tier 74*b*—Blue Terrain Fourth Tier
75*a*—Red Terrain Fifth Tier 75*b*—Blue Terrain Fifth Tier
76—Center Tier 77—Female thread (Typical)
78—Male thread (Typical) 79—Optional game stand
79*a*—Connecting rod 79*b*—Base
79*c*—Base cover

DETAILED DESCRIPTION OF THE INVENTION

Figure 1:
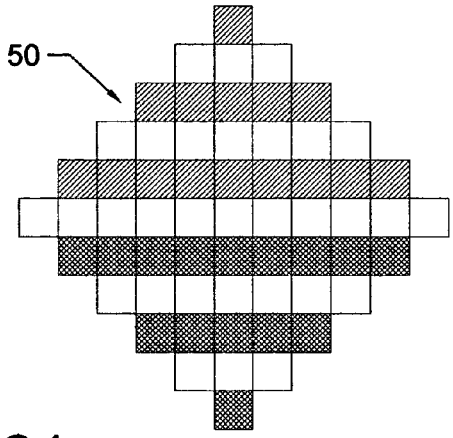
FIG. 1 is a top view of the game structure
Figure 2:
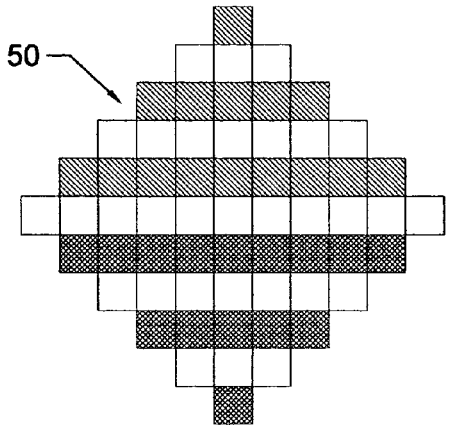
FIG. 2 is a bottom view of the game structure.
Figure 3:
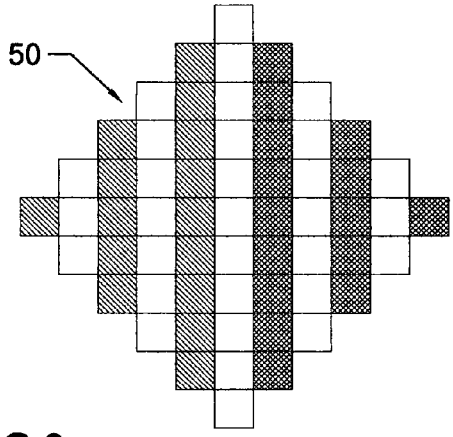
FIG. 3 is a right view of the game structure.
Figure 4:
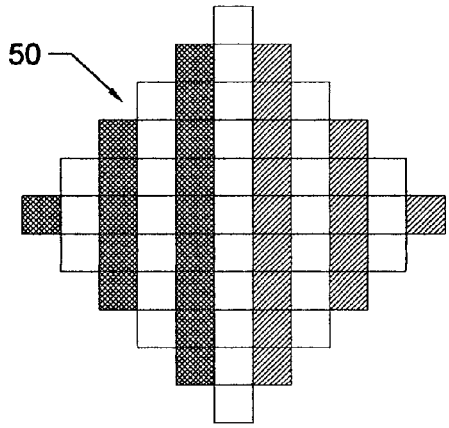
FIG. 4 is a left view of the game structure.
Figure 5:
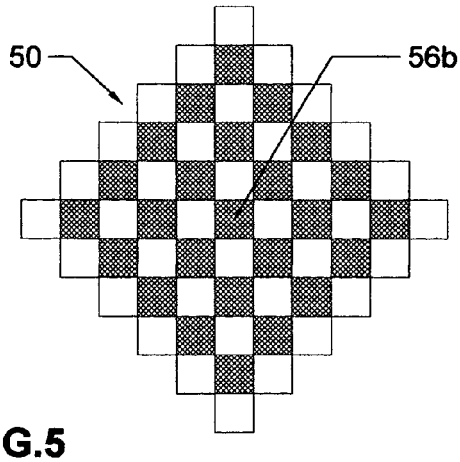
FIG. 5 is a front view of the game structure.
Figure 6:
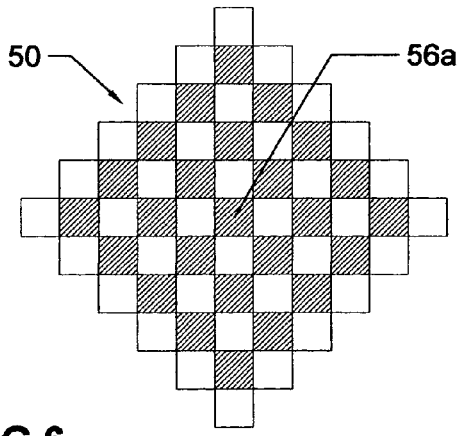
FIG. 6 is a back view of the game structure.
Figure 7:
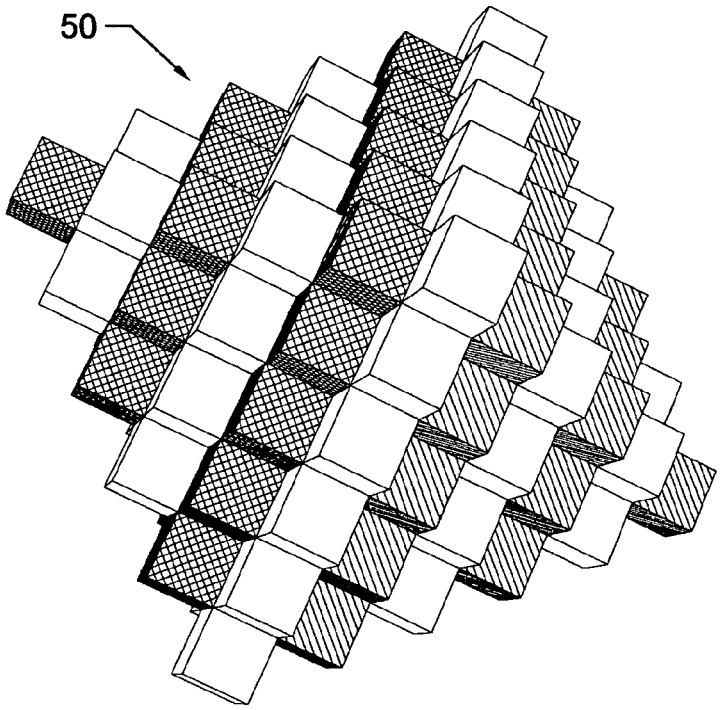
FIG. 7 shows a perspective view of the game structure without the game pieces.
Figure 11:
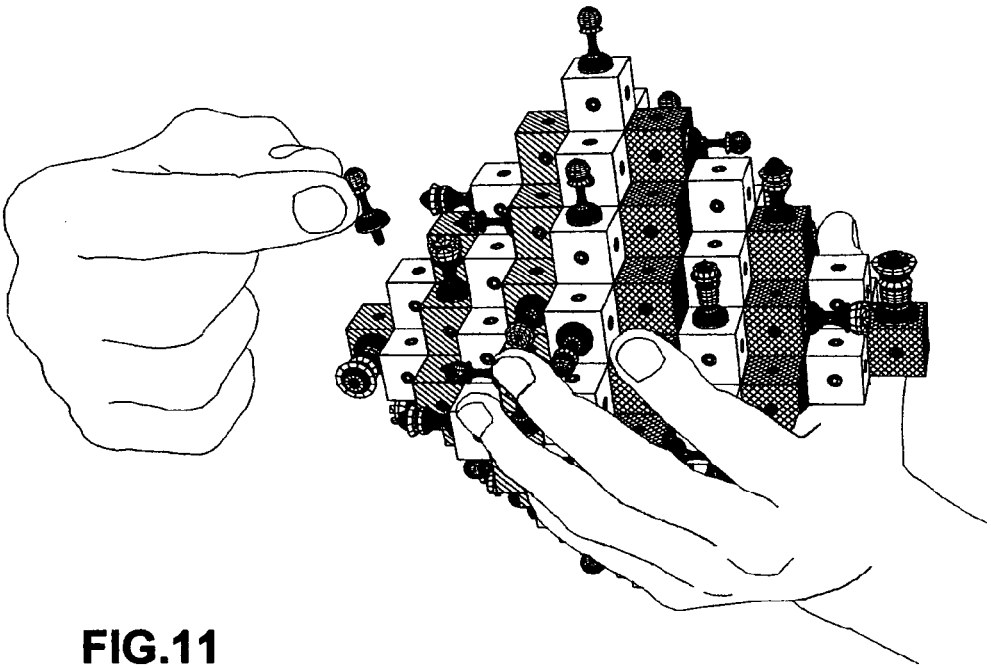
FIG. 11 illustrates the physical configuration version of the game apparatus with human hands.
Figure 12:
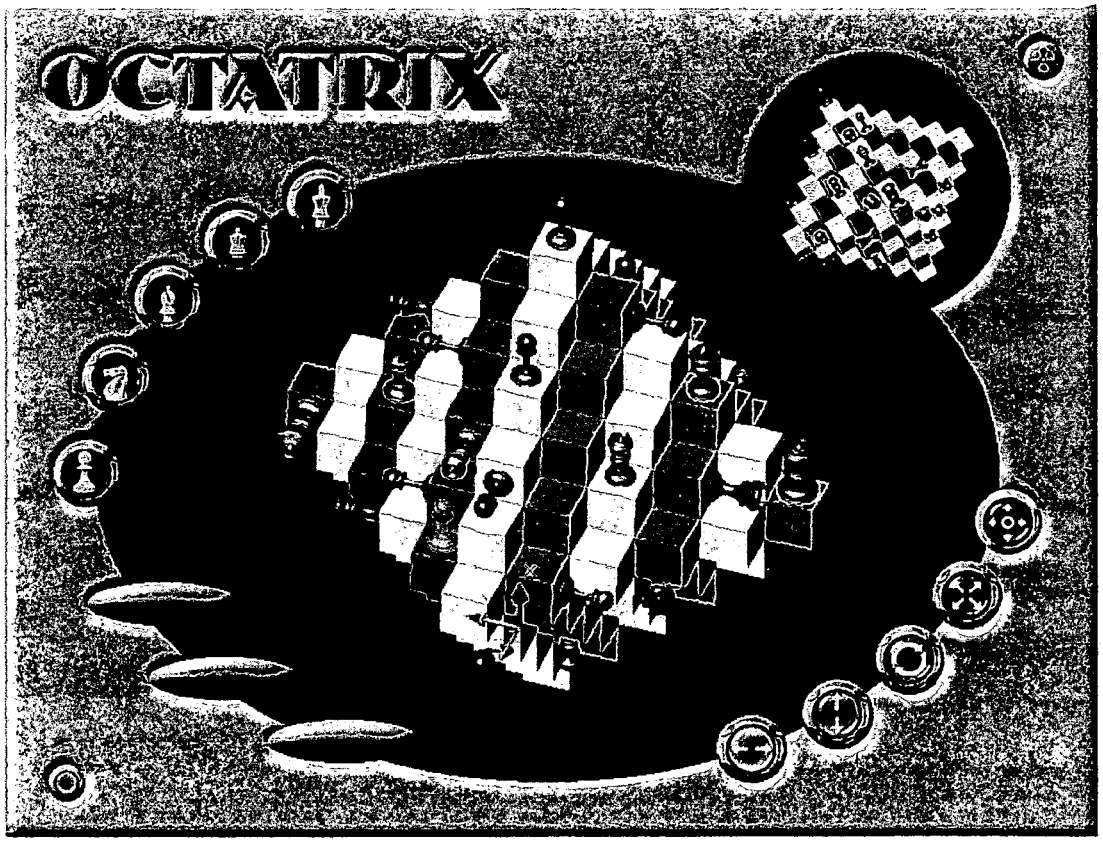
FIG. 12 illustrates the prototype of electronic simulation version of the present invention.

Referring to FIG. 1 through FIG. 6, an octahedron-shaped Game structure 50 is disclosed to solve the problems of the prior arts. FIG. 7 shows the perspective view of the Game structure 50. A plurality of cubes is introduced to configure the shape of octahedron. This is an improvement which distinguishes the present invention from the prior arts. By these cubic surfaces, the game pieces can have the same degree of movement in three-dimensional direction. The present invention can be played either on the electronic simulation version or on the physical configuration version. The electronic simulation version of the present invention is shown in FIG. 1 through FIG. 8. The physical configuration version of the present invention is shown in FIG. 9 through FIG. 11. A prototype screenshot of the electronic simulation version is shown in FIG. 12. Referring to FIG. 13 through FIG. 24, drawings were illustrated in electronic simulation concept. Omitting male and female treads from the drawing will make the game structure and game piece movements easy to understand.

Figure 8:
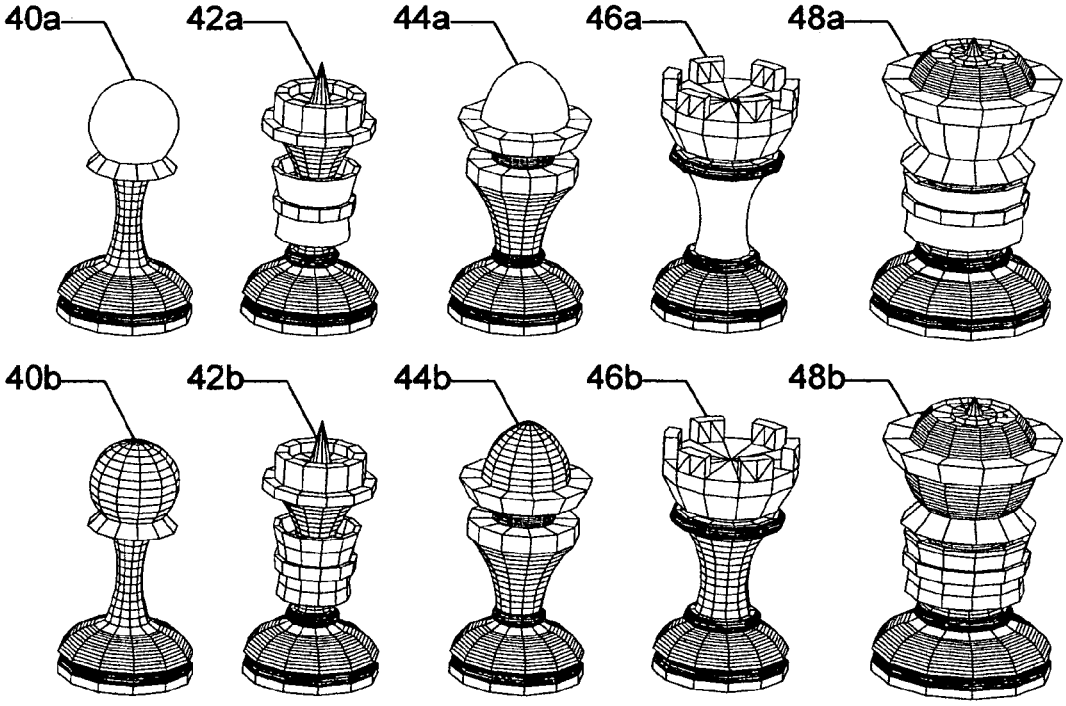
FIG. 8 shows the game pieces for the present invention. (Electronic simulation version)
Figures 9, 10:
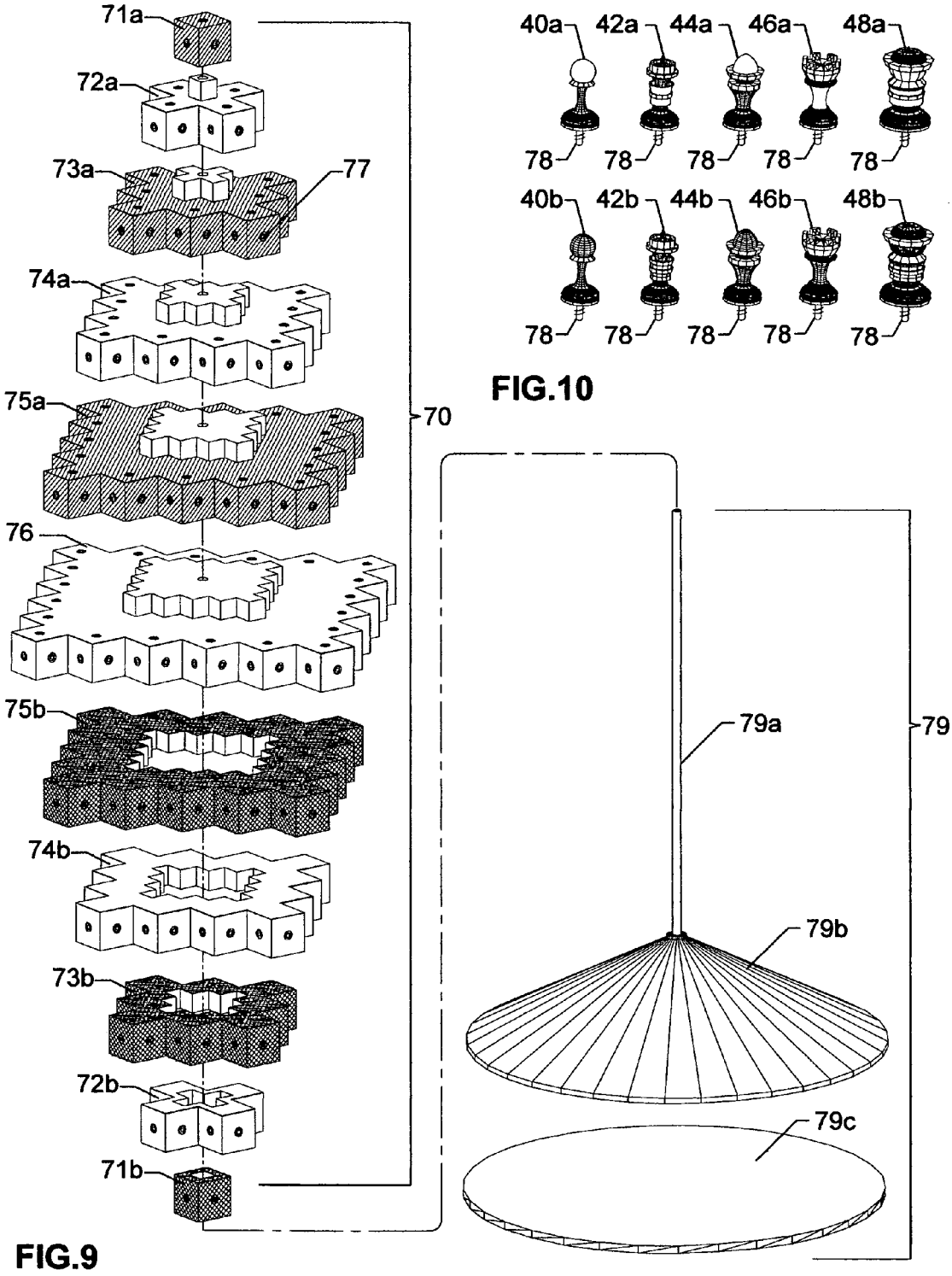
FIG. 9 illustrates the exploded view of the game structure. (Physical configuration version)
FIG. 10 illustrates the game pieces with male threads. (Physical configuration version)

The game pieces for the present invention are shown in FIG. 8. The game pieces can take many different configurations, therefore game pieces shown in the present invention are purely arbitrary and various other shapes may be assigned to these game pieces to stimulate interest and variety in the games. The present invention is a game for two players, therefore contrasting coloration is used for the game structure and game pieces. It defines two different terrains and two different armies. Referring again to FIG. 1 through FIG. 6 of the drawings, the game surface is shown such that the various cubic surfaces are hatched with different colors. Any appropriate distinguishing colors may be employed to cause the surfaces to stand out more strongly. For instance, the blank surface could be white, the parallel line surface could be red, and the cross-hatched surface could be blue. Two sets of game pieces are shown in the Red army and the Blue army. In this way, any movements made on the game surface could be quickly and easily identified.

Figure 14:
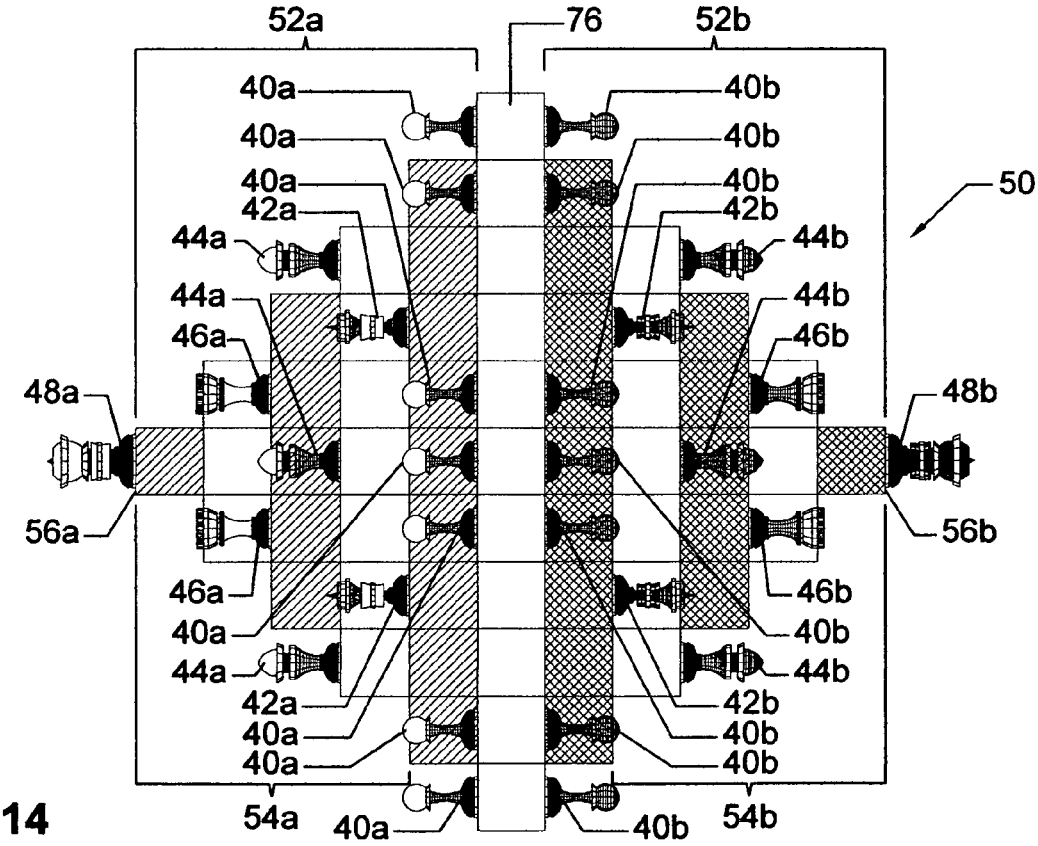
FIG. 14 shows the starting positions of the game pieces from the right view.

FIG. 9 is an exploded view showing the physical configuration version of Game structure 70. The preferred embodiment of Game structure 70 has an arrangement of 11 tiers. The material used for Game structure 70 is any rigid material in color or the like. Each tier has its own concave and convex shapes to interconnect each other. Tiers 71*a*, 72*a*, 73*a*, 74*a*, 75*a*, 76, 75*b*, 74*b*, 73*b*, 72*b*, and 71*b* in the game structure can be made by injection molding process and they are assembled together as shown. Each terrain 52*a* and 52*b* has 5 tiers on each side, and a Center Tier 76 in the middle is shown in FIG. 14. The tiers should have the game surfaces, therefore Female thread 77 is disposed on the predetermined location on each tier.

FIG. 9 also shows Optional game stand 79 consisting of Connecting rod 79*a*, Base 79*b* and Base cover 79*c*. A hole is drilled through the center of tiers and then they are threaded with Optional game stand 79 in case of game is on hold. The space between Base 79*b* and Base cover 79*c* can be used as a storage space for the game pieces. FIG. 10 illustrates the game pieces with Male thread 78. The male thread can be a screw type, so that game pieces can be placed on the surfaces of the Game structure 70. Male thread 78 fits into Female thread 77 for a snug fit.

FIG. 11 illustrates the physical configuration version of game apparatus with human hand. Predetermined size of Game structure 70 enables the human hand to reach and grasp a game piece and move the grasped game piece to a new position. FIG. 12 illustrates a prototype screenshot of electronic simulation version. It is to be understood that it is within the scope of the present invention also to provide corresponding electronic implements thereof for use on programmable digital computers and other microprocessor-based electronic devices. Electronic implements of the standard two-dimensional chess game have been known for more many years, and it is well within the skill of the programming art to adapt those implements to the various embodiments of the present invention. The present invention can be played on electronic simulated systems which include systems like the console games, personal computer games and Internet on-line games, etc.

The goal of the present strategy game is to capture the opponent's king, however game can be also ultimately won if a pawn advances all the way to the opponent's pinnacle (56*a* or 56*b*). The pinnacle (56*a* or 56*b*) is the last surface of each army's terrain (52*a* or 52*b*). If the king is in check and threatened with attack, it must get out of check immediately. If there is no way to get out of check, the position is checkmate, and the player that is checkmated loses. These combinations result in a more complex and unpredictable strategy game with many more strategic permutations possible than in conventional chess. In this specification a game structure is sometimes called a "structure", a game piece is sometimes called a "piece", and a game surface is sometimes called a "surface".

The player with the Red army moves one of his or her game pieces first, and then each player must take a turn moving their pieces one at a time using the rules for game piece movement described below. The player may not move a piece to a surface already blocked or occupied by one of his or her own pieces. But the player can capture an opponent piece that blocked on a surface where one of his or her own pieces can move onto that surface. The captured piece plays no further role in the game and is removed from the game structure.

Figure 13:
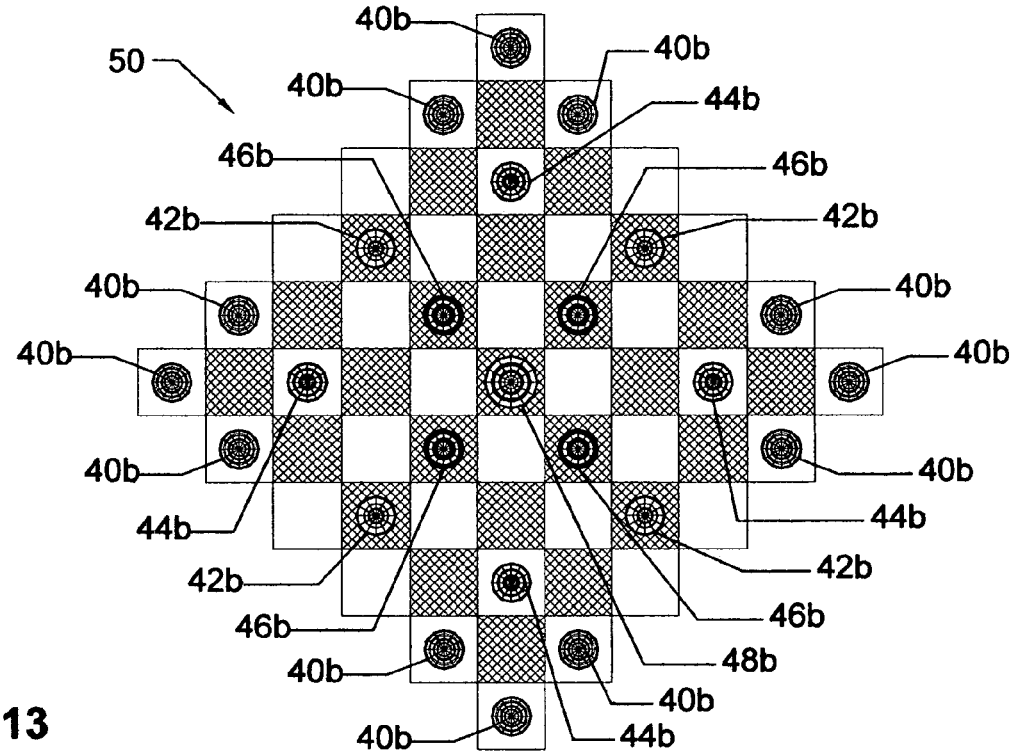
FIG. 13 shows the starting positions of the game pieces from the front view.

FIG. 13 and FIG. 14 show the starting positions of a plurality of the game pieces. Two sets of game pieces position on the same colored terrain before the commencement of the game. In the present invention, each player is provided with 25 chess-like pieces, each set having the same number and types of game pieces. Each player has the following game pieces: a king, four rooks, four bishops, four knights, and twelve pawns. The game pieces may, of course, be known by other names, but conventional chessman name is introduced to the average amateur chess player to learn the present invention in a relatively easy manner. Terrain shows the relative ranking or hierarchy between the various game pieces. At the beginning of the game, the game pieces are set up according to the power of hierarchy: King-Rook-Bishop-Knight-Pawn. The kings (48*a* or 48*b*) are positioned at the pinnacles (56*a* or 56*b*) and the pawns (40*a* or 40*b*) are positioned at Center Tier 76.

Figure 15:
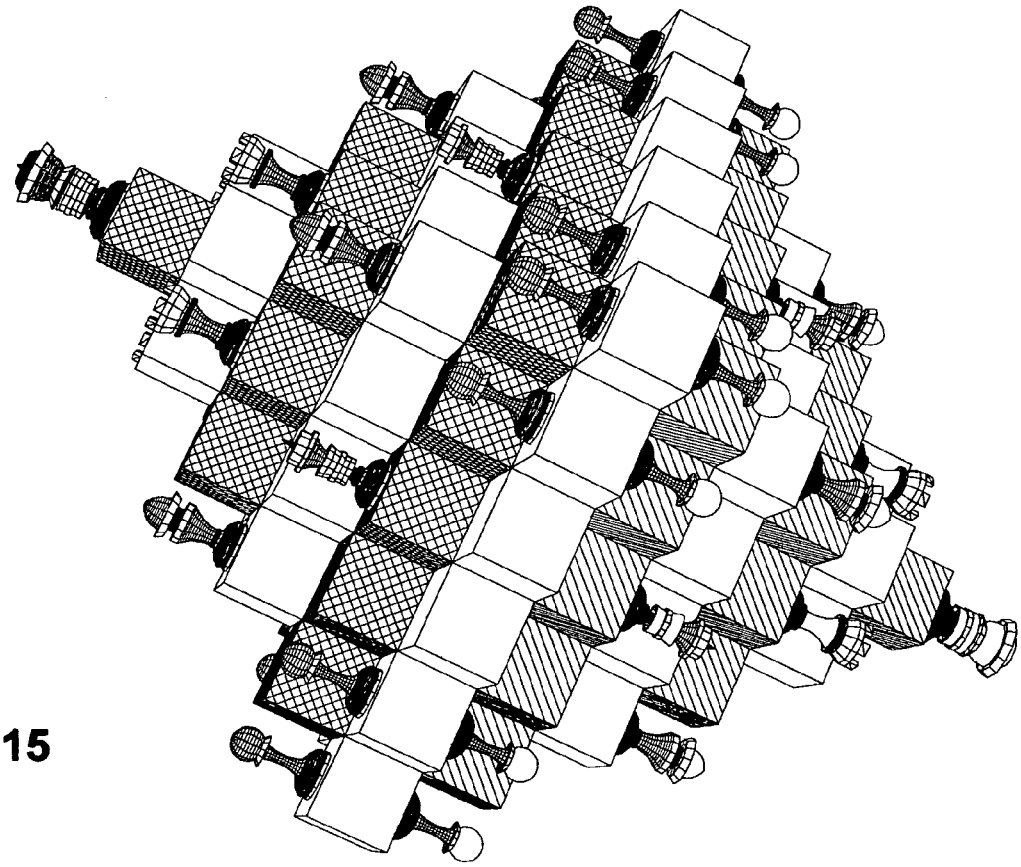
FIG. 15 shows a perspective view of the game structure with game pieces at the commencement.

FIG. 14 shows Red terrain 52*a* and Blue terrain 52*b*. The each terrain has 5 tiers. Red terrain 52*a* is for the Red army and Blue terrain 52*b* is for the Blue army. Some special rules are imposed on the pawn's movement and the knight's movement. Red Pawns 40*a* are not allowed to travel on Red Terrain 52*a* and Blue Pawns 40*b* are not allowed to travel on Blue Terrain 52*b*. This makes the pawns offensive game pieces since their role is to advance to opponent's pinnacle. Red Knights 42*a* are not allowed to travel beyond No Red Knight zone 54*a*. Blue Knights 42*b* are not allowed to travel beyond No Blue Knight zone 54*b*. FIG. 15 shows a perspective view of the game structure with game pieces at the commencement of a game. The present invention may best be described in this drawing.

Figure 16:
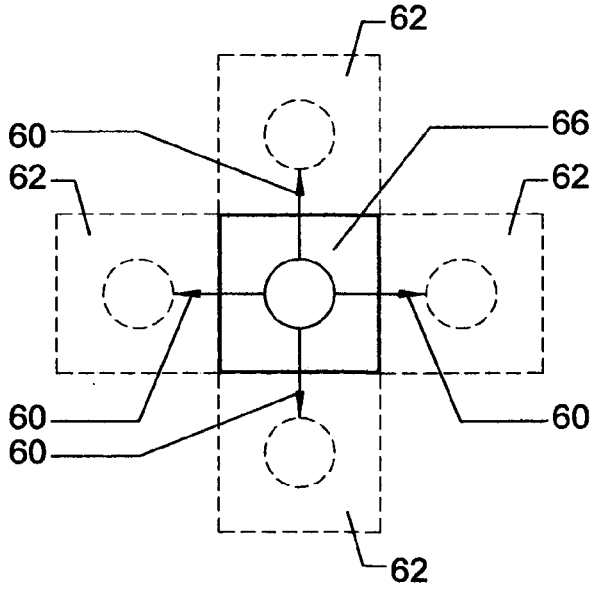
FIG. 16 illustrates the notation for the Cross-dimensional movement of the game piece.

FIG. 16 shows the notation for Cross-dimensional movement 60 of the game piece. This is another improvement which distinguishes the present invention from the prior arts. The movements are somewhat similar but different than conventional chessmen, because the game surfaces are based on cubic configurations. The present invention would have additional directions of movement for the game pieces, and they can have the same degree of movement in three-dimensional direction. These aspects are what makes the game fully three-dimensional, rather than just a planar game with multiple levels as shown on the prior arts. This is a diagrammatic illustration of game piece movement, which orthogonally moves its Blocked surface 66 to Adjacent surface 62 in four different dimensions.

Figure 17:
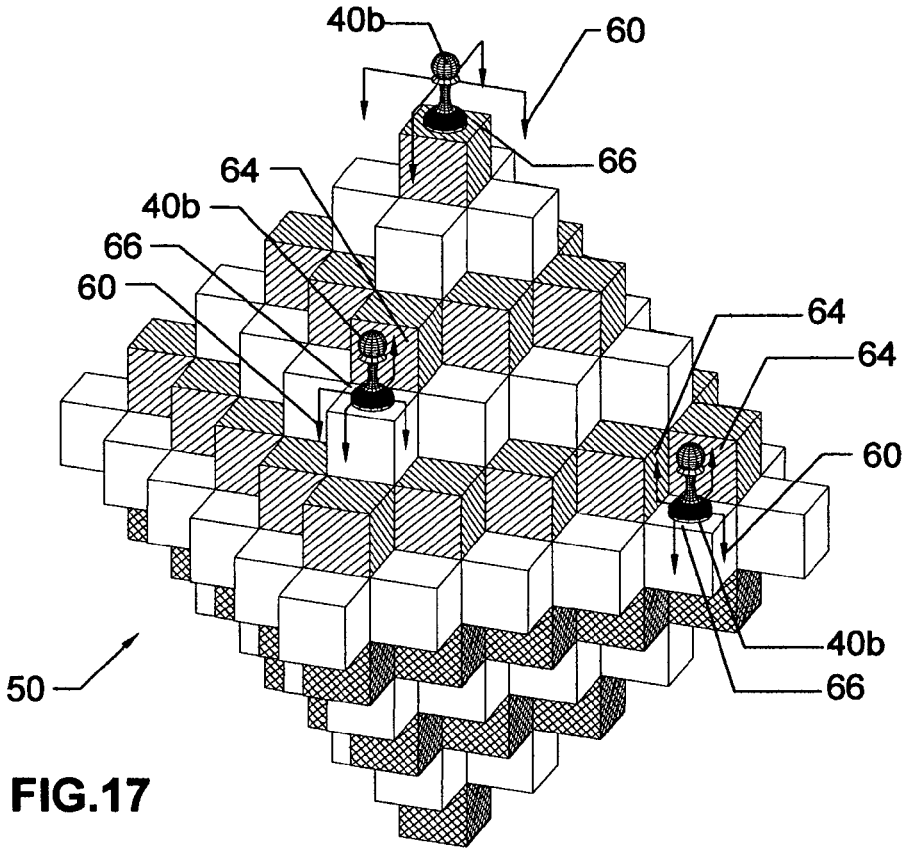
FIG. 17 illustrates the definitions of the Blocked surface and the Occupied surface.

The game surfaces of the Game structure 50 are essential to the present invention. Certain game pieces may be blocked from movement by the presence of other pieces, either of the same color or the opponent's color. The surface where the game piece is positioned is called "Blocked surface 66". The four surfaces adjacent to "Blocked surface 66" are called "Adjacent surface 62". Among "Adjacent surface 62", the surfaces are immediately occupied by "Blocked surface 66" is particularly called "Occupied surface 64". FIG. 17 illustrates definitions of "Blocked surface 66" and "Occupied surface 64". It also illustrates Cross-dimensional movement 60 on the game structure. In the preferred embodiment, game surfaces can only be blocked and occupied by one player's piece at a time.

Figure 18:
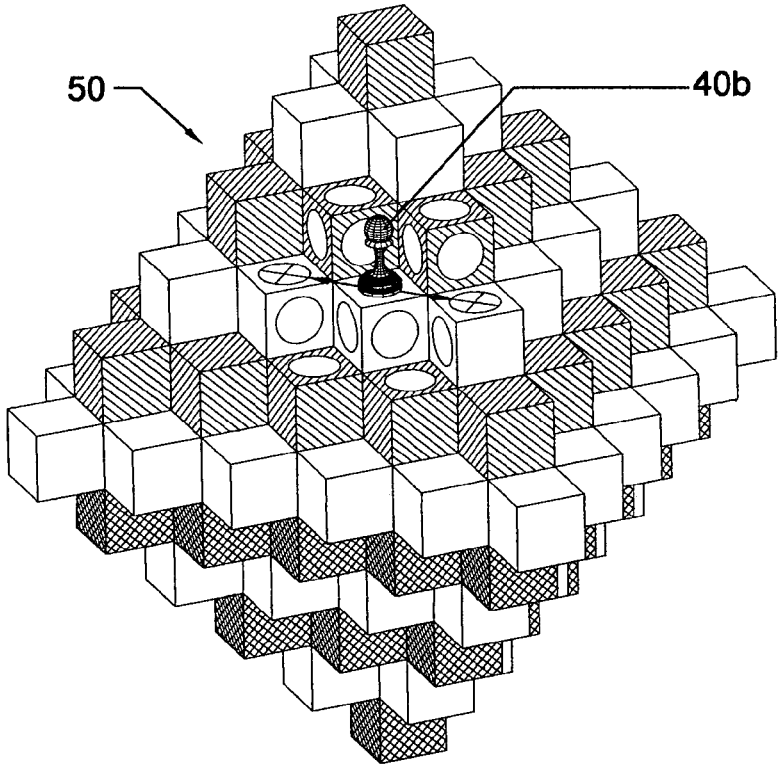
FIG. 18 shows the movements of the pawn.

FIG. 18 shows the movements of the pawn (40*a* or 40*b*). It illustrates Blue Pawn 40*b* is traveling on Red Terrain 52*a*. The surfaces with the "O" symbols indicate possible destinations for the pawn. The pawn moves two surfaces using any Cross-dimensional movement 60 at a time, but if opponent's game piece is in same dimensional surface diagonally, it can move one surface diagonally to capture the opponent's game piece marked by the "X" and the "O" symbols. If a pawn advances all the way to the opponent's pinnacle (56*a* or 56*b*), it is called "Pinnacling" and the game is finished. The pawns cannot travel on their own terrain, and this makes the pawns offensive pieces either to capture the opponent's piece or to advance to the opponent's pinnacle. The important rule to remember is that the pawn cannot capture the opponent's pawn. The pawns can only be captured by the royalty pieces. The royalty pieces are a king, a rook, a bishop, and a knight.

Figure 19:
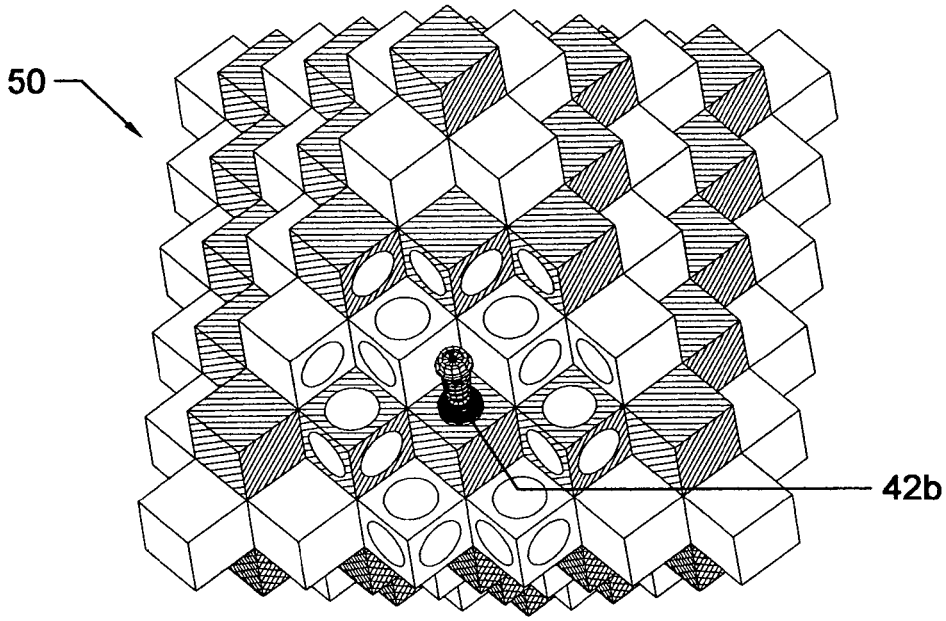
FIG. 19 shows the movements of the knight

FIG. 19 shows the movements of the knight (42*a* or 42*b*). It illustrates Blue Knight 42*b* is traveling on Red Terrain 52*a* and Center Tier 76. The knight moves three surfaces using any Cross-dimensional movement 60 at a time. The surfaces with the "O" symbols indicate possible destinations for the knight. The knight hops directly from its old surface to its new surface. The knight can jump over other pieces between its old and new surfaces. But the knight has limited travel zone. It cannot travel on its own terrain fourth tier and above (54*a* or 54*b*). This makes last defensive area for the knight is its own terrain fifth tier (75*a* or 75*b*), but it can travel opponent's terrain without any restriction.

Figure 20:
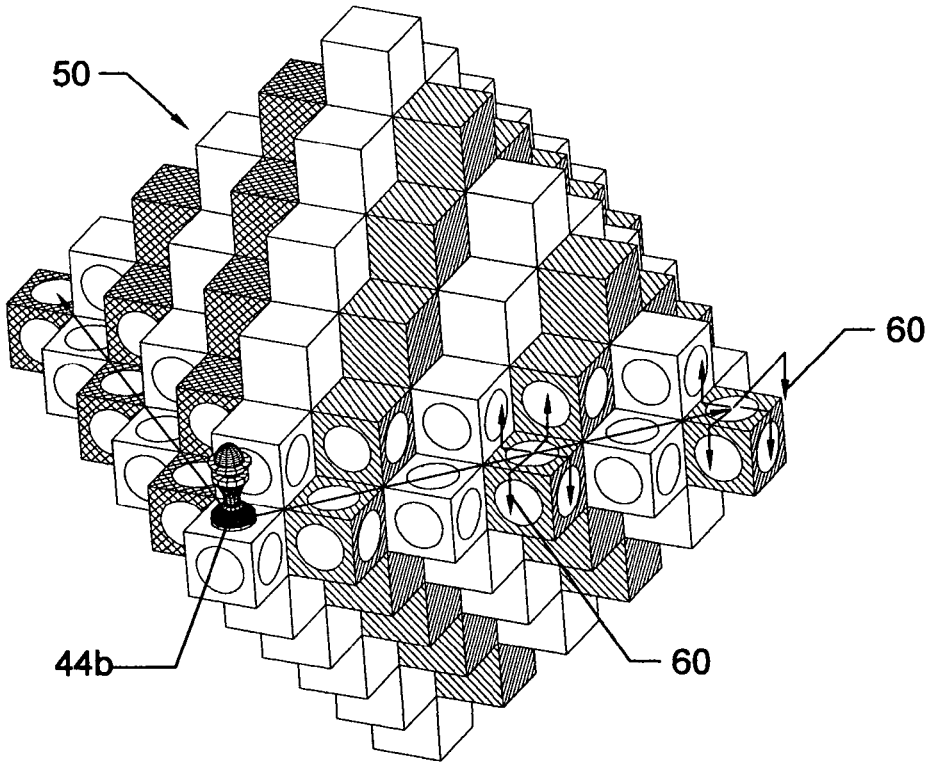
FIG. 20 shows the movements of the bishop.
Figure 21:
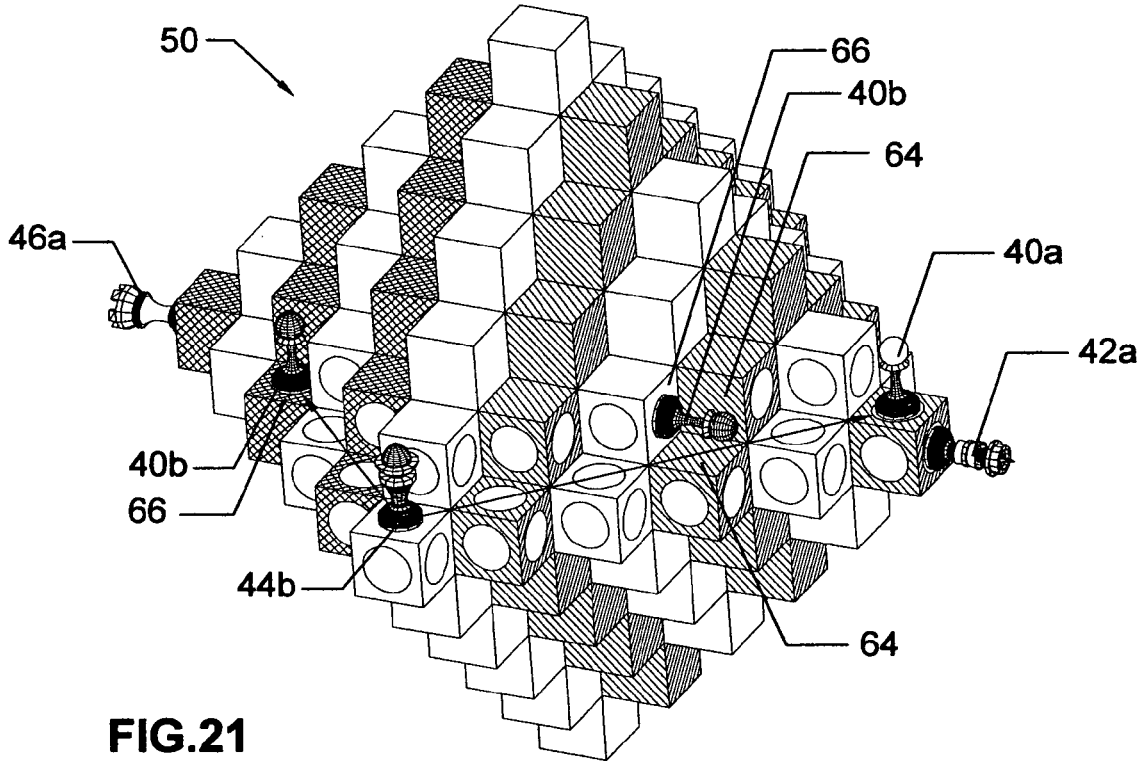
FIG. 21 illustrates the blockage of the bishop.

FIG. 20 shows the movements of the bishop (44*a* or 44*b*). The bishop's movement is special. The Bishop can move any number of surfaces diagonally if its path is not blocked. The bishop performs not only its diagonal linear movement, but also makes offensive or defensive movement on adjacent surfaces where it blocks. In other words, it performs diagonal linear movement as well as Cross-dimensional movement 60 at the same time. The bishop also moves one surface at a time when it does not use its diagonal linear movement. The bishop can reach any of surfaces with "O" symbol in FIG. 20. The blockage of the bishop is shown in FIG. 21. The bishop can pass through Occupied space 64, but cannot pass through Blocked surface 66. FIG. 21 illustrates Blue Bishop 44*b* cannot attack Red Rook 46*a*, because it is blocked by Blue Pawn 40*b*. But Blue Bishop 44*b* can pass through Occupied surface 64 and capture Red Pawn 40*a*. Red Knight 42*a* cannot be captured at the same time, because the game rule can only allow a player to capture one opponent's piece at a time.

Figure 22:
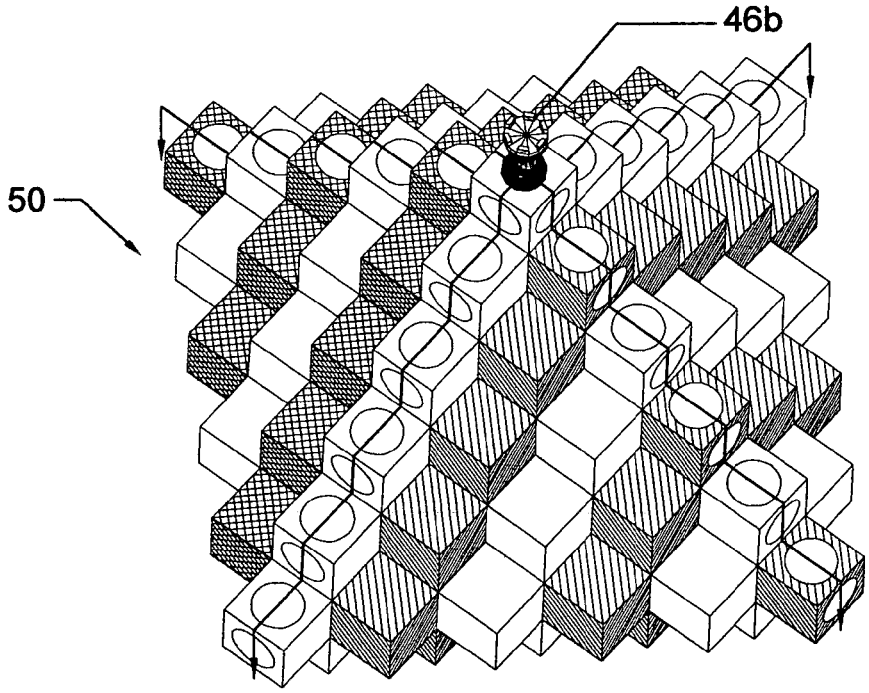
FIG. 22 shows the movements of the rook.
Figure 23:
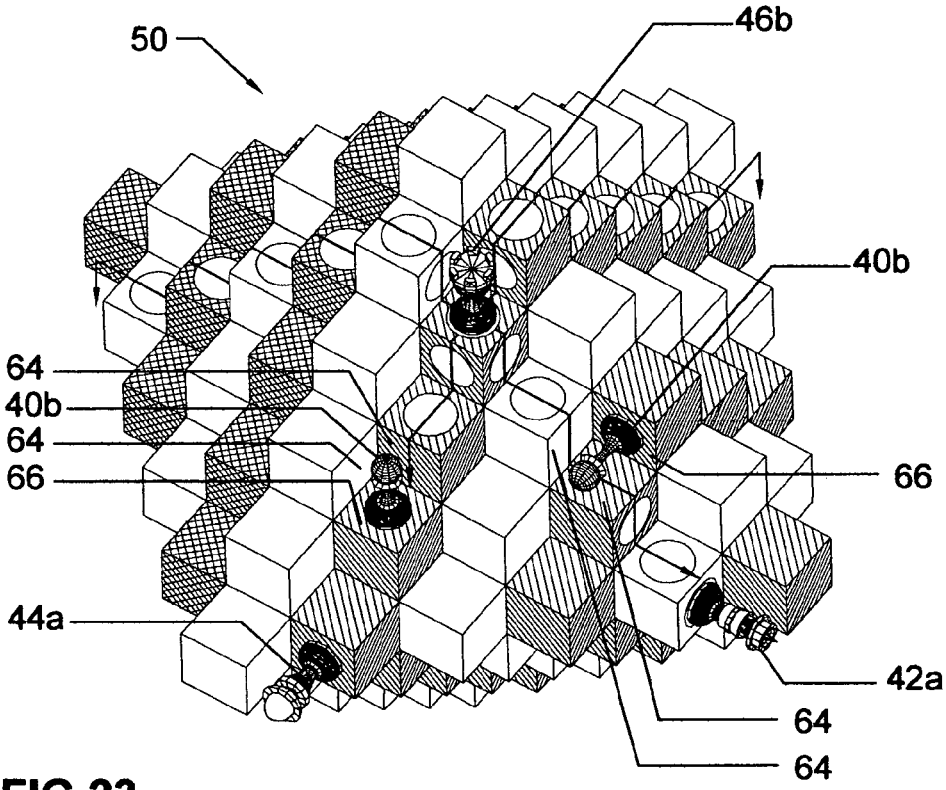
FIG. 23 illustrates the blockage of the rook.

FIG. 22 shows the movements of the rook (46*a* or 46*b*). The rook can move any number of surfaces vertically and horizontally in any orthogonal directions if its path is not blocked. The surfaces with "O" symbol indicate possible destinations for the rook. The rook can make its offensive and defensive movements on hemisphere of the game structure from its current position. FIG. 23 illustrates the blockage of the rook. Blue Rook 46*b* can pass through Occupied surface 64 and capture Red Knight 42*a*. But Blue Rook 46*b* cannot capture Red Bishop 44*a*, because it is blocked by Blue Pawn 40*b*.

Figure 24:
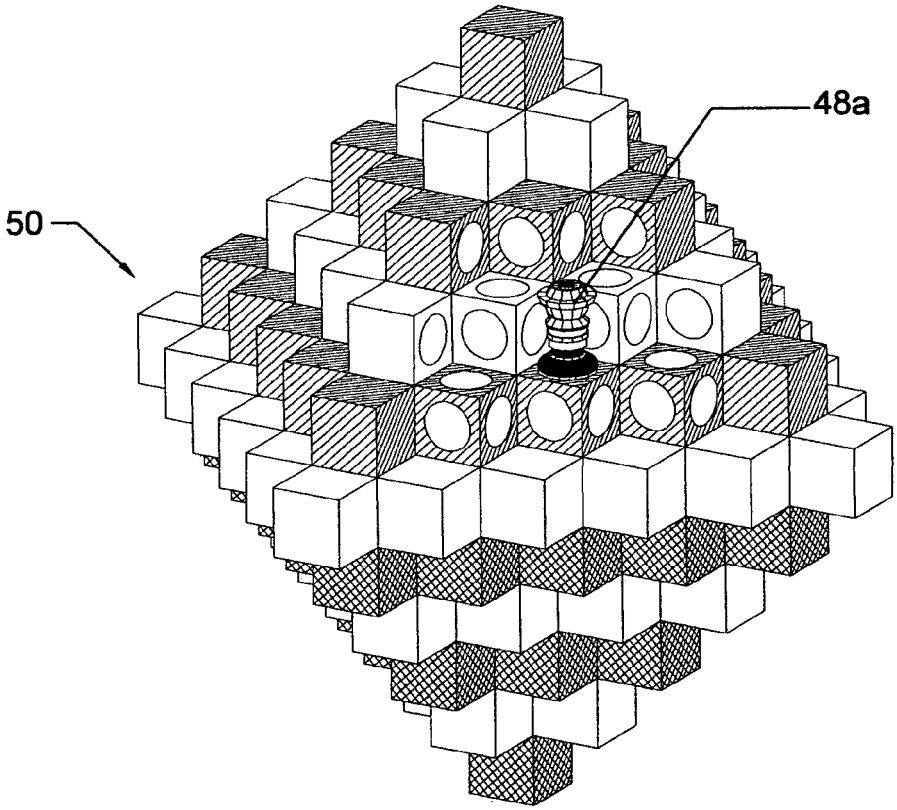
FIG. 24 shows the movements of the king.

FIG. 24 shows the movements of the king (48*a* or 48*b*). The king is the most important piece. When the king is captured, its whole army loses. The king may never move into check—that is, onto a game surface attacked by an opponent's piece. The king can move like either pawn or knight, but cannot travel beyond its own terrain (52*a* or 52*b*). The surfaces with "O" symbol indicate possible destinations for the king. FIG. 20 illustrates Red King 48*a* is traveling its own Red Terrain 52*a*, but it cannot travel on Center Tier 76. If the king is in check, it must get out of check by capturing the attacking opponent's piece, or by placing one of its own game pieces between the attacking opponent's piece, or by moving the king away from the attack. If a checked player can do none of these, he or she is checkmated and loses the game. If the king is not in check, but that player can make no legal move, the position is called stalemate and the game is scored as a draw, or tie.

It is to be realized that a great many variations are possible to the game structure and the game rules which are presented as alternate embodiments of the invention. One possible variation of the game structure is that additional tiers can be added or subtracted for more complex or simpler game. Additional game pieces can be added or reduced accordingly. Another possible variation is multiple game structures for multiple players. Several game structures can be added and joined together for the additional players. Other types of polyhedron can be introduced to configure an octahedron-shaped game structure. It should be understood that many of the preferred moves of the game pieces may be altered in some fashion, without departing from the spirit of the invention.

While the invention has been described and illustrated in detail, it is to be clearly understood that this is intended by way of illustration and example only and is not to be taken by way of limitation. Persons skilled in the art will readily see that a great many variations are possible within the spirit and scope of the present invention. Thus the scope of the invention should be determined by the appended claims and their legal equivalents, rather than by the examples given.

I claim:

1. A three-dimensional game apparatus, comprising:

(a) an octahedron game structure having eleven levels of three-dimensional geometrical configurations, said levels including;

(b) a central level constituting peripheral cubic configurations including four corner cubes with five faces exposed and sixteen intermediate cubes with four faces exposed as game playing surfaces;

(c) second and third adjacent upper and lower levels of three-dimensional cubic configurations each having four corner cubes with four faces exposed and twelve intermediate cubes with three faces exposed as game playing surfaces;

(d) fourth and fifth upper and lower levels of three-dimensional levels adjacent to second and third levels each having four cubes with four faces exposed and eight intermediate cubes with three faces exposed as game playing surfaces;

(e) sixth and seventh upper and lower levels of three-dimensional cubic configurations each having four corner cubes with four faces exposed and four intermediate cubes with three faces exposed as game playing surfaces;

(f) eighth and ninth upper and lower levels of three-dimensional cubic configurations each having four corner cubes with four faces exposed as game playing surfaces;

(g) tenth and eleventh upper and lower levels of three-dimensional cubic configurations including one cube with five faces exposed as game playing surfaces; and the game apparatus further including (h) a predetermined number of game pieces individually identifiable;

(i) means for attaching each game piece to the exposed faces of cubes in the octahedron.

2. A multi-level game structure for three-dimensional game, comprising;

(a) a plurality of game levels having peripheral cubic configurations mounted one over the other and including a middle level at the center and a predetermined number of upper and lower levels at levels above and below said middle level;

(b) said middle level including four corner cubes with five faces exposed and a predetermined number of intermediate cubes with four faces exposed as game playing surfaces;

(c) said upper and tower levels having four corner cubes with four faces exposed and four less intermediate cubes than the a predetermined number of intermediate cubes in adjacent levels with three faces exposed as game playing surface;

(d) the levels adjacent to a top level and a bottom level of said peripheral cubic configurations each having four corner cubes with four faces exposed as game playing surfaces;

(e) said top level and bottom level of said peripheral cubic configurations each including one cube with five faces exposed as game playing surfaces;

(f) a predetermined number of game pieces individually identifiable;

(g) means of attaching each game piece to exposed faces of cubes in game structure.

3. An octahedron-shaped game apparatus for use with a plurality of attachable game pieces, comprising:

(a) an odd number of game tiers having peripheral cubic configurations mounted one over the other and including a middle tier at the center level and upper and lower tiers at levels above and below said middle tier;

(b) said middle tier including four corner cubes with five faces exposed and a predetermined number of intermediate cubes with four faces exposed as game playing surfaces;

(c) each upper and lower tier having four corner cubes with four faces exposed and four less intermediate cubes than the predetermined number of intermediate cubes in adjacent tier with three faces exposed as game playing surface;

(d) the tiers adjacent to a top tier and a bottom tier of said peripheral cubic configurations each having four corner cubes with four faces exposed as game playing surfaces;

(e) said top tier and bottom tier of said peripheral cubic configurations each including one cube with five faces exposed as game playing surfaces; and the game apparatus further including (f) a predetermined number of game pieces individually identifiable;

(g) means for attaching each game piece to the exposed faces of cubes in the octahedron.

* * * * *